US006652652B1

(12) United States Patent
Naschberger

(10) Patent No.: US 6,652,652 B1
(45) Date of Patent: Nov. 25, 2003

(54) DEVICE FOR PATTERNING TWO-DIMENSIONAL SUBSTRATES WITHOUT A TEMPLATE

(76) Inventor: Anton Naschberger, Lausbichl Nr. 9, 6330 Kufstein (AT)

( * ) Notice: Subject to any disclaimer, the term of this patent is extended or adjusted under 35 U.S.C. 154(b) by 0 days.

(21) Appl. No.: 09/869,195

(22) PCT Filed: Dec. 1, 1999

(86) PCT No.: PCT/EP99/09345

§ 371 (c)(1),
(2), (4) Date: Sep. 18, 2001

(87) PCT Pub. No.: WO01/40564

PCT Pub. Date: Jun. 7, 2001

(51) Int. Cl.[7] ..... B05C 5/00

(52) U.S. Cl. ..... 118/323; 118/315; 8/499; 8/483; 427/424; 347/4; 347/40

(58) Field of Search ..... 118/323, 315, 118/697, 698, 305; 8/483, 478, 485, 499; 427/256, 288, 424; 347/4, 37, 40, 44, 73

(56) References Cited

U.S. PATENT DOCUMENTS 4,344,990 A * 8/1982 Wollam et al. ..... 427/286
4,573,057 A * 2/1986 Sutera et al. ..... 347/74
4,841,306 A 6/1989 Archer et al.
5,751,305 A * 5/1998 Hadley ..... 347/19
5,838,343 A * 11/1998 Chapin et al. ..... 347/22
6,106,107 A * 8/2000 Sheinman ..... 347/75
6,116,158 A * 9/2000 DeMoore et al. ..... 101/177

FOREIGN PATENT DOCUMENTS

AT 347897 1/1979

* cited by examiner

*Primary Examiner*—J.A. Lorengo
*Assistant Examiner*—Michelle A Lazor
(74) *Attorney, Agent, or Firm*—Mattingly, Stanger & Malur, P.C.

(57) ABSTRACT

A device (1) for patterning plane substrates (5) without a template includes at least one stationary printing station (2) which applies a substance to the substrate and the substrate (5) passes the station along a conveying path. Each printing station (2) is equipped with a dye-spraying head (21) mounted on a carrying device (22). The spraying head carrying device (22) is part of a movable unit (3) which can be displaced to a side in a direction transverse to the conveying direction (B) of the substrate (5) out of a first operating position (I), adopted in the patterning region of the substrate (5), into a second set-up and service position (II), which partially releases the substrate (5).

14 Claims, 4 Drawing Sheets

DEVICE FOR PATTERNING TWO-DIMENSIONAL SUBSTRATES WITHOUT A TEMPLATE

The invention relates to a device for patterning plane substrates without a template, in particular textiles, carpets, sheeting or similar substrates, comprising at least one stationary printing station, which applies a substance to the substrate and the substrate passes the station along a conveying path, each printing station being equipped with a dye-spraying head coordinated to the width of the substrate to be printed and a carrying device, extending in the longitudinal direction of the station over the width of the substrate, as well as transversely to the conveying direction thereof, and carrying the spraying head.

The dye-spraying head of each printing station of a generic device comprises a plurality of dye nozzles, which are provided in particular in matrix arrangement in rows and columns. In one configuration of a printing machine of this kind the dye nozzles are arranged distributed over the width of the substrate in a stationary arrangement. The machine comprises in particular several printing stations, one or more dyes being allocated to the spraying head of each printing station. The substrate resting on a back cloth is continuously transported and led past and under the dye nozzles, for example at a distance of a few millimeters. Another device of the generic type comprises at least one printing station, in which dye nozzles, also arranged in rows and columns, are part of a modular dye-spraying head. A head of this kind is mounted on a stationary carrying device, it being movable within this carrying device parallel to the substrate in a longitudinal and/or transverse direction.

Generally the generic device is of a kind in which the printing station is provided with a stationary carrying device for the dye-spraying head and the substrate is patterned by means of the controlled nozzles without a template. Carpets, floor tiles, mats, rugs, products in lengths, sheeting or blankets are printed, for example. Textiles and other substrate materials can also be printed. Patterns can be repeated in any desired number and it is also possible to make the repeat distance -of the pattern very large, at an interval of 50 metres or more, for example.

Many different patternings with regard to variety of dye and pattern can be produced precisely and with excellent print quality by electronic control of the dye nozzles in the arrangements mentioned. High speeds, for example, 30 m/min, are also achieved. For the generic device it is of particular importance to avoid or largely reduce dwell or set-up times. Also it should be possible to carry out a change in dye and/or pattern without interrupting production.

The aims mentioned are achieved according to the invention in conjunction with the features of the initially mentioned device in that the spraying head carrying device is part of a movable unit which can be displaced to the side in a direction transverse to the conveying direction of the substrate out of a first operating position, adopted in the patterning region of the substrate, into a second set-up position, which at least partially releases the substrate. With the mobile spraying head unit according to the invention it is achieved that the spraying head of a station can be added to or removed from the production line, i.e. the conveying path of the substrate in the shortest time. The spraying head is made accessible by the lateral displacement, so in the set-up or service position it can be serviced, cleaned, adjusted or manipulated in any other specific way. The production line is available for unrestricted operation with the spraying heads which have remained in the operating position, without being hindered by implementation of the service position.

A very precise lateral displacement of the mobile spraying head unit is advantageously obtained if the device comprises a rail guide structure supporting the mobile spraying head unit movably in the longitudinal direction of the printing station.

In a particular configuration the mobile spraying head unit is formed by a movable bar (spraying bar) extending in the longitudinal direction of the printing station. A bar of this kind can be supported and moved particularly easily and advantageously by means of the rail guide.

A preferred embodiment of the invention consists in that the rail guide structure comprises a stationary set-up stand, which at least partially accommodates the mobile spraying head unit, preferably in the form of the bar, in the set-up/service position. Advantageously in this arrangement the printing station and the set-up stand are equipped with rails in alignment with one another for displacing the mobile spraying head unit. Between the rails on the one hand of the printing station and on the other hand of the set-up stand a space is preferably provided which is bridged by the mobile spraying head unit when it is displaced.

Preferably several successive printing stations are provided along a production line, each of which is equipped with a mobile spraying head device. In particular by adding and/or removing selected mobile spraying head units specific changes in patterning, re-setting and/or in adapting to changed substrate models can be carried out. In some cases changes of this kind can take place without interrupting production. It is particularly advantageous if two adjacent printing stations can be combined into and operated as one printing station pair, a space, accessible in the service/set-up position, preferably being provided between two pairs of adjacent printing stations.

A further embodiment of the invention consists in that the mobile spraying head unit comprises the spraying head carrying device as well as a stand extending in the longitudinal direction of the station and under the spraying head carrying device and movable in the longitudinal direction of the station. Suitably, the spraying head carrying device is mounted on one side only of one end of the movable stand in such a way that an open space is formed between the movable stand and the spraying head carrying device, in which the substrate to be patterned comes to lie. In an arrangement of this kind in the operating position of the spraying head the movable stand is located under the printing platform and/or a conveyor belt, whereas it is only positioned on the longitudinal side of the machine or production line in the set-up/service position. In this case the movable stand is provided in the manner of a drawer in an insert space assigned to it on the production line underneath the print application device for the substrate.

Subordinate claims are aimed at the configurations of the invention mentioned and other practical and advantageous configurations of the invention. Particularly practical and advantageous embodiments or possibilities of the invention are described in more detail with the aid of the following description of the embodiment examples illustrated in the schematic drawings.

Figure 1:
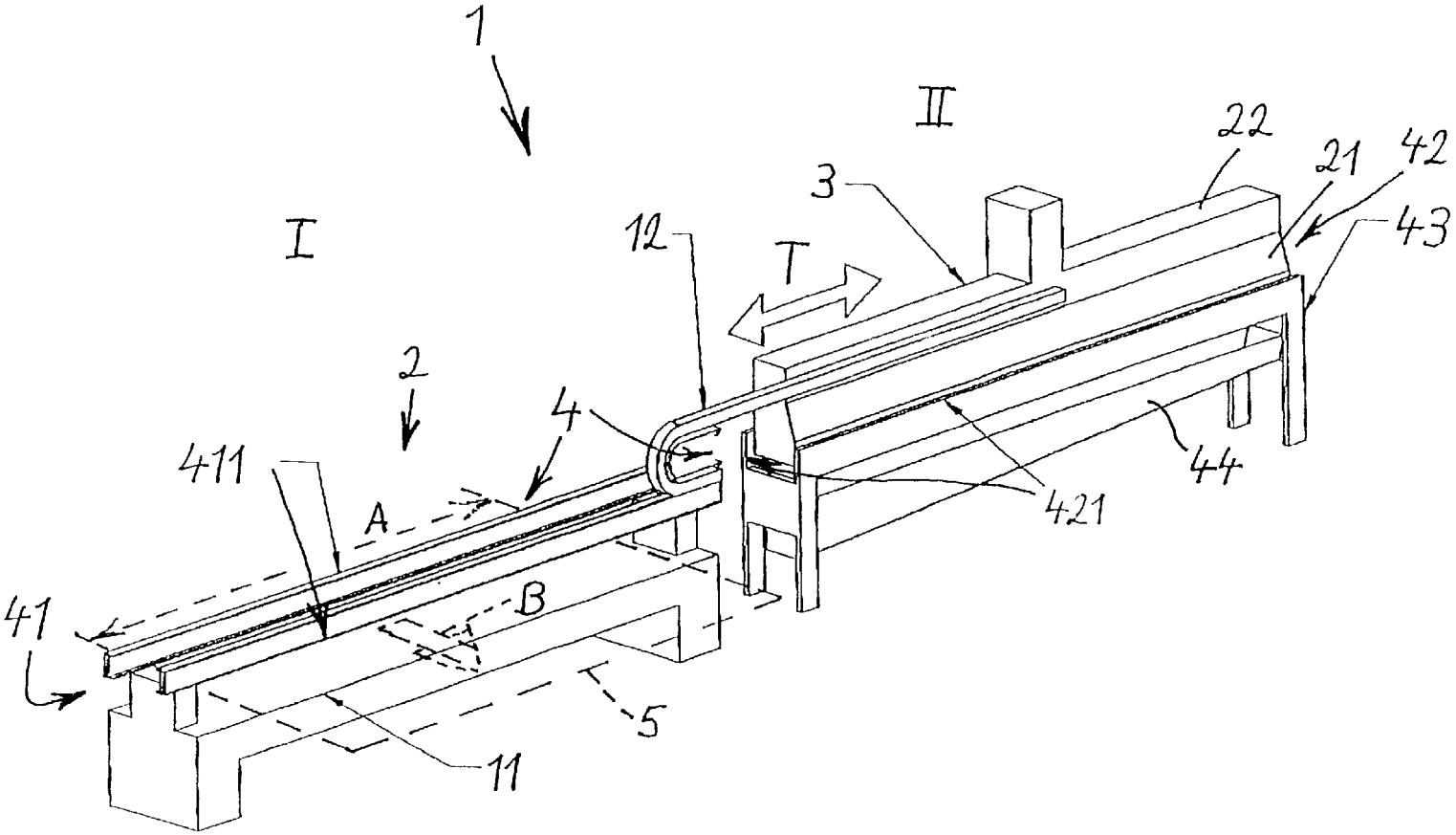
FIG. 1 shows in perspective view the printing station of a device according to the invention with a movable spraying bar and a stationary set-up stand associated therewith.

A device 1 according to the invention according to FIG. 1 comprises a printing station 2 with a movable dye-spraying head 21 and a stationary set-up stand 43 associated with the station 2. The printing station 2 comprises a printing platform 11 forming an application device for a substrate 5. Above the printing platform 11 is provided a rail guide 41 with a pair of parallel rails 411, at a horizontal distance from one another, which extend vertically to the transport/conveying direction B of the substrate 5 over the printing platform 11. The substrate 5 is supported in the usual way on a conveyor belt, not shown, which passes over the platform 11 in conveying direction B.

The rail guide 41 of the printing station 2, together with a further rail guide 42, is part of a rail guide structure 4. The rail guide 42 comprises two parallel rails 421, arranged at a horizontal distance from one another on the upper side of the set-up and service stand 43. The stand 43 is constructed and erected in alignment with the printing platform 11 and laterally next to it in such a way that the rails 411 and the associated rails 421 extend at the same height and are in alignment with one another.

In the state illustrated in FIG. 1 the dye-spraying head 21 is located outside the region of the printing platform in a set-up/service portion II. This position II is achieved by the mobile arrangement, according to the invention, of the dye-spraying head 21 by means of the rail guides 41 and 42 which form a set path of sideways travel. The dye-spraying head 21 is formed a bar 3, which extends in the longitudinal direction of the printing station 2 at a length corresponding to the length of the printing platform. This bar 3 is the carrying device 22 for a plurality of dye nozzles, arranged in rows and columns on the underside of the bar and not shown in FIG. 1. The spraying bar 3 is provided with the dye nozzles over its entire length.

The bar 3 comes to rest with its lower part between the rails 421. It is held and guided by these rails 421. It can be seen that the bar 3 arrives by simple displacement along the rails 421 between the rails 411, which guide it into operating position I above the printing platform 11 and hold it there. In this manner the bar 3 forms a mobile spraying head unit which according to choice can be displaced in a lateral direction and in a horizontal plane into the first operating position I, adopted in the patterning region of the substrate 5, or in the second set-up/service position II, which releases the substrate 5. The stand 43 is approximately the same length as the bar 3 in the dimension corresponding to the width of the substrate A.

An elastic cable chain 12 is joined to the end of one rail 411 of the printing station 2 to produce the data and power connection between the movable spraying bar 3 and the stationary stand of the printing station 2. The other end of the cable chain 12 is joined laterally to the bar 3 in the centre thereof. It can be seen that the cable chain 12 follows the movement direction of the bar 3. In the state illustrated in FIG. 1 in the set-up position II the cable chain is completely removed from the region of the printing platform 11. When the spraying bar 3 is pushed into the rail guide 41 the cable chain rests on one rail 411.

Between the printing platform 11 and the stand 43 the distance is made large enough for the space between the platform 11 and the stand 43 to be accessible. This access space is used when the bar 3 is brought into its operating position I. As the bar 3 in its set-up position II is advantageously, as shown in FIG. 1, moved right up to the stand 43, the access space 13 can also be used in this arrangement. For this purpose the cable chain is then held at a height which allows free passage under the chain.

In position II on the stand 43 in particular servicing, cleaning, adjustment and/or replacement operations can be carried out. The region between the rails 421 is also open on the set-up stand 43, so substance dripping from the dye nozzles on the underside of the bar 3 and/or cleaning fluid ends up in a drip trough 44, arranged on the platform-like substructure of the stand 43 and extending over the entire length of the stand.

Figure 2:
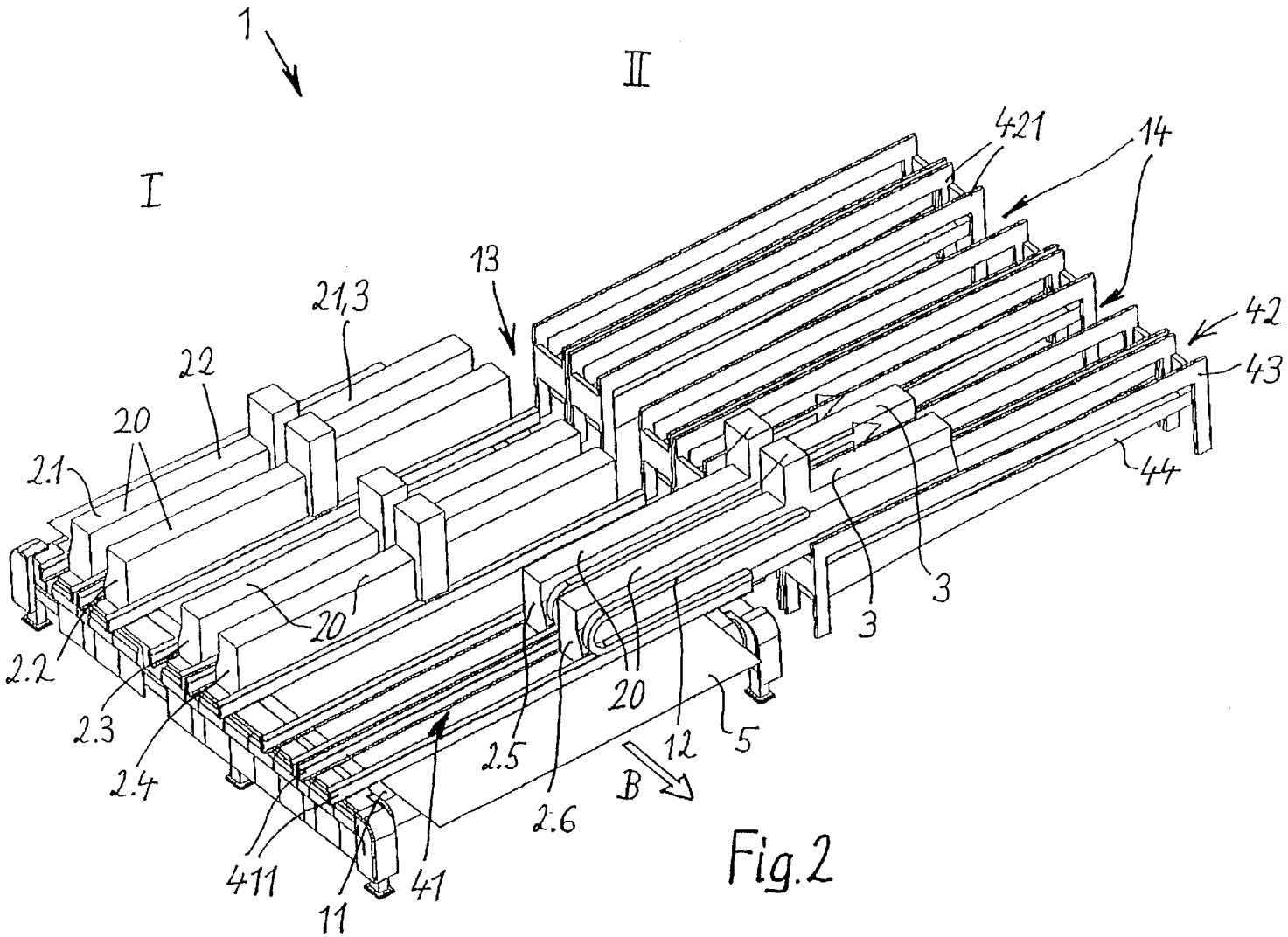
FIGS. 2 and 3 show in perspective view as well as in horizontal projection a row of successive printing stations of the kind according to FIG. 1 arranged in pairs.
Figure 3:
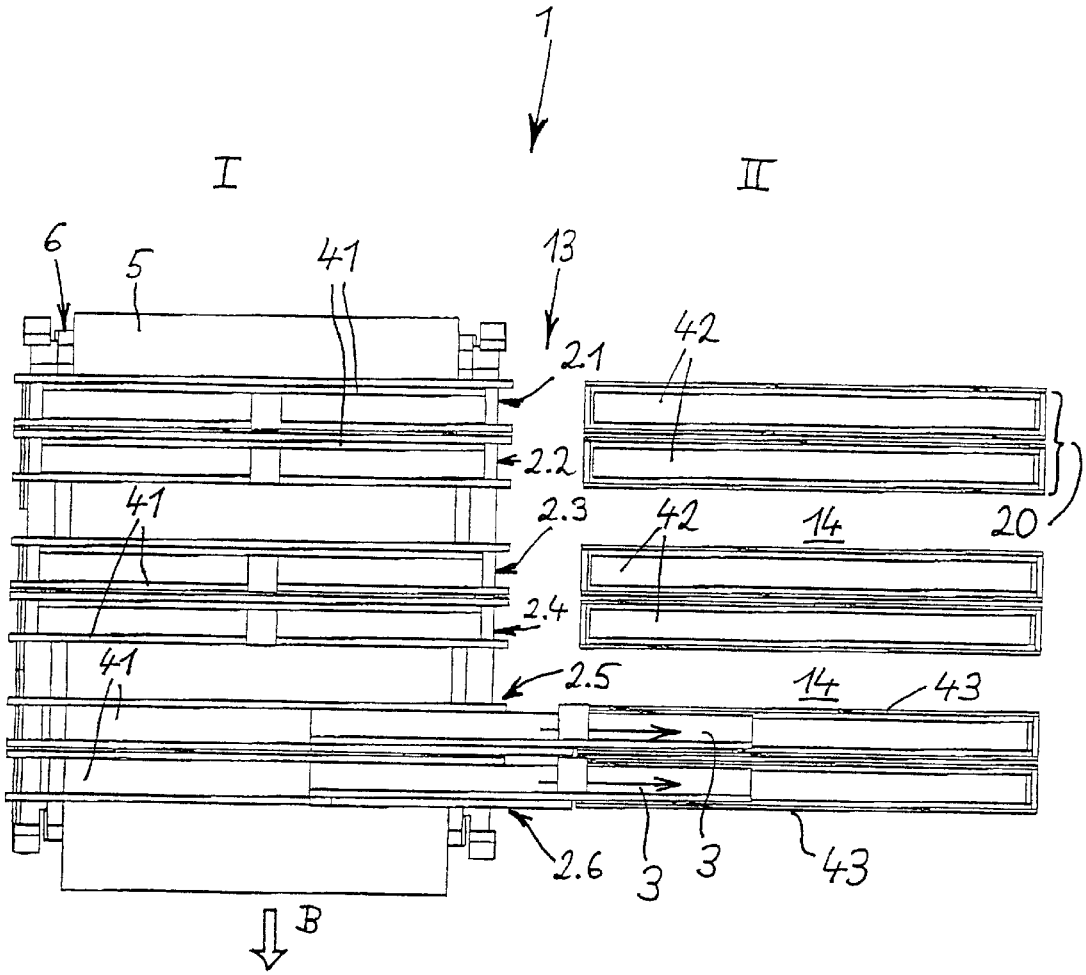

A device according to the invention according to FIGS. 2 and 3 is put together from a plurality of printing stations 2 with associated stands 43. The stations 2.1 to 2.6 are arranged next to one another in a row along a production line. A system evolves which can be particularly economically and simply operated and in addition can be quickly adjusted to very different applications and requirements.

As can particularly be seen in the horizontal projection in FIG. 3, printing stations 2.1, 2.2 are arranged close together in the form of a pair of stations 20. This pair of printing stations 20 is followed by two further printing stations 2.3, 2.4 and 2.5, 2.6, respectively combined into a pair. The pairs of stations 20 follow at an interval corresponding to an access space 14. The access space 14 arises between the associated pairs of stands 43. This arrangement in pairs is of great advantage, as in this way the mobile units in the form of the bars 3, moved into the set-up/service positions II , are easily accessible. A bar located completely in the set-up/service position II is held ready for operation, serviced, cleaned and/or replaced in this position.

All data and power connections are produced by means of the respectively carried cable/power chain without additional connection measures. On stations 2.5 and 2.6 the cable chain 12 in FIG. 2 can respectively be seen on the front longitudinal side of the bar, while the cable chains 12 in the other stations run on the longitudinal sides of the bar at the back in FIG. 2 and are not visible.

The individual printing platforms 11 of a station are put together in the order of stations 2.1 to 2.6 into a plane longitudinally extending layout and support platform for a substrate 5. The substrate 5 can, for example, be a product extending longitudinally, for example, a length of carpet which in the layout according to FIGS. 2 and 3 can be conveyed at high speed by transport means 6 in direction B. Conveyance speeds of up to 30 m/min are achieved with no problem. Depending on the patterning requirement, any desired combination of stations 2.1 to 2.6 can be put into operation. Owing to the pairing and arrangement, according to the invention, of the printing stations of the layout in FIGS. 2 and 3 it is even possible to continue the production operation without interruption, if, for example, two spraying head bars 3 are taken out of production operation. In FIGS. 2 and 3 the bars 3 of stations 2.5, 2.6 are in fact located in a transitory position between the printing platforms 11 and the associated stands 43. In this phase the bars bridge the space 13 between the platforms 11 and the stands 43. It can be seen that bars 3 are securely guided even in these takeover positions, as the length of the guide rail 41, 42 holding and guiding each bar 3 is long in comparison to the distance forming the space 13. Alternatively the rails 411 and 421 can, however, be permanently connected to one another.

On the end side facing away from the set-up/service stand 43 the rail guide 41 is equipped with buffer elements. The bar 3 is pushed against a buffer element of this kind, so it comes to a halt in a fixed pre-set mechanical position. This position correlates to electronically detectable positions for steering the bar 3.

Figure 4:
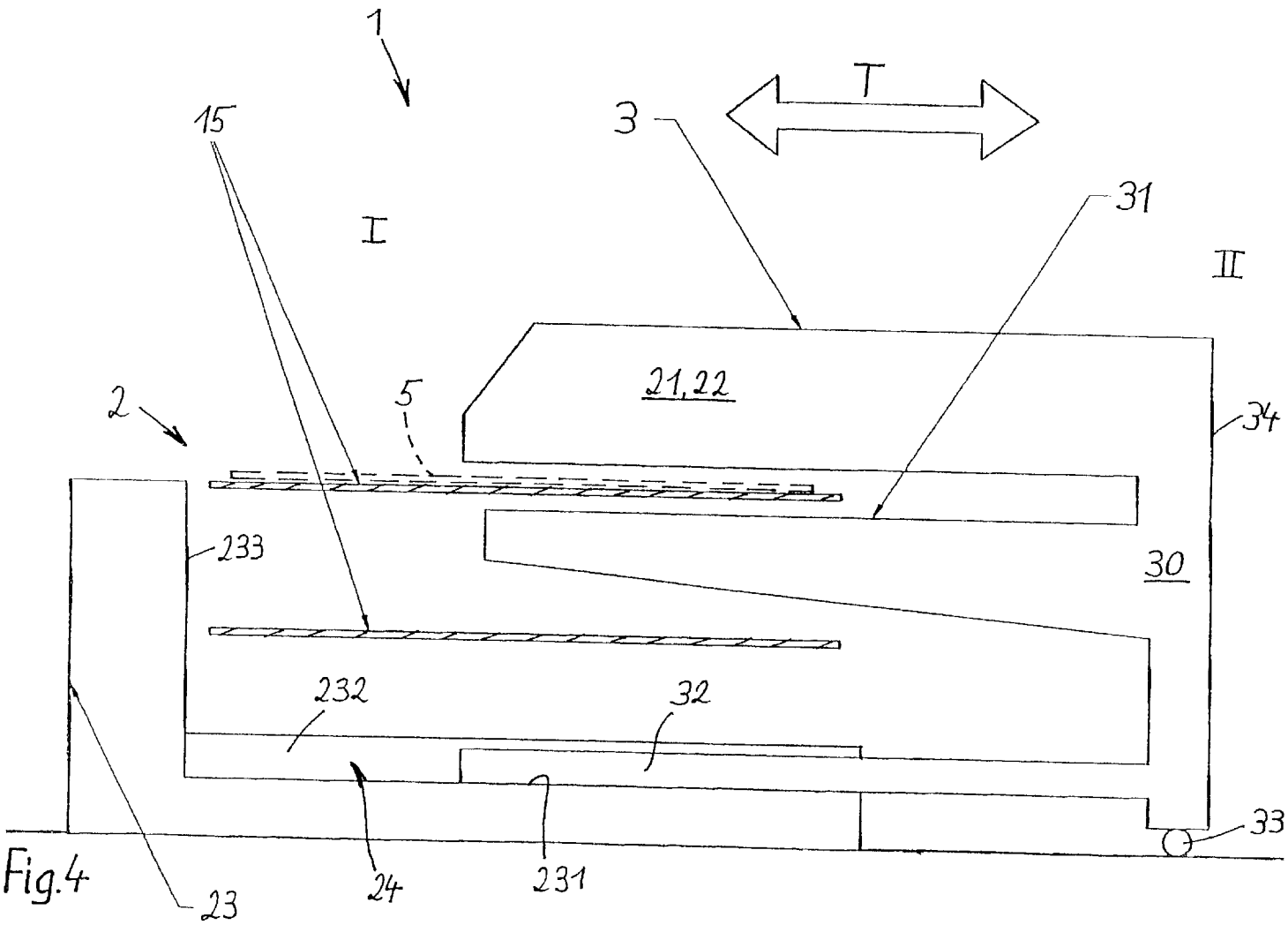
FIG. 4 shows in longitudinal view a station of a device according to the invention with a mobile spraying head unit comprising a movable stand.

In FIG. 4 a further embodiment of a device 1 according to the invention is illustrated. This comprises a printing station 2 with a movable unit 3. A spraying head carrying device 22 is an integral part of a movable stand 30 of the unit 3.

The movable stand 30 comprises a bottom guide frame 32, which engages in the manner of a drawer in an allocated drawer space 24 of a stand 23 of the printing station 2. Herein the guide frame 32 rests so as to be movable by pushing on a bottom guide face 231 and on side guide faces 232. The guide frame 32 is equipped with wheels on the side facing away from the stand 23, in order to be able to move the movable stand 30 in direction T perpendicular to the conveying direction of the substrate 5.

The movable stand 30 is equipped with an end-side vertically directed supporting wall 34. This wall 34 is supported and fastened in the region of the wheels 33 on the bottom frame 32 and it carries on its upper end the spraying head carrying device 22. This is provided in the form of a bar which forms the dye-spraying head 21, in which dye nozzles, not illustrated, are arranged. The extension length of the bar dye-spraying head 21 corresponds to the length or the operational width of the printing station 2. Underneath the bar dye-spraying head 21 a trough is provided to catch dye substance and/or cleaning fluid. This trough 31 extends parallel to the bar head 21 over its length.

As can be seen in FIG. 4 a slot-type open space remains between the bar head 21 and the trough 31, in which the upper side of a conveyor belt 15 comes to rest when the movable stand 30 is completely pushed in. The lower side of the conveyor belt 15 comes to rest in a space open to the stand 23 underneath the trough 31 between this and the guide frame 32.

It can be seen that the movable stand 30, illustrated in FIG. 4 in an intermediate position, can easily be moved out of operating position I, in which the dye nozzles are located above the substrate 5, into the set-up/service position II. The bottom frame 32, the trough 31 and the bar spraying head 21 are dimensioned with such a length that the stand 30 releases the entire operating/printing region in its position II, moved completely to the side. In addition the spraying head 21 is hereby freely accessible on the side of the printing station for set-up, servicing and/or cleaning operations. With the mobile unit 3 it is also achieved that the dye-spraying head 21 can be inserted into the production line or removed from it as required. In particular these changes are possible without interrupting the production operation.

Because the unit 3 with bottom movable stand 30 can be moved to the side, the unit 3 is accessible without difficulty for set-up and service operations and the access space along a device with several successive stations is optimally used.

What is claimed:

1. A device for patterning a plane substrate without a template, comprising at least one stationary printing station which applies a substance to the substrate as the substrate passes the printing station along a conveying path, each printing station being equipped with a dye-spraying head having a width corresponding to the width of the substrate to be printed and a dye-spraying head carrying device extending in a longitudinal direction of the printing station over the width of the substrate as well as transversely to a conveying direction thereof and carrying the dye-spraying head, characterized in that the dye-spraying head carrying device is part of a movable unit which is displaceable to a side along a set path in a direction transverse to the conveying direction of the substrate out of a first operating position, adopted in a patterning region of the substrate, into a second set-up and service position which at least partially releases the substrate.

2. A device according to claim 1, characterized in that the set path comprises a rail guide structure supporting the movable unit movably in the longitudinal direction of the printing station.

3. A device according to claim 1, characterized in that the movable unit is formed by a movable bar, extending in the longitudinal direction of the printing station.

4. A device according to claim 2, characterized in that at least one rail guide of the rail guide structure is arranged above a contact surface for the substrate.

5. A device according to claim 2, characterized in that th e rail guide structure comprises a stationary set-up stand, which at least partially accommodates the movable unit, in a set-up/service position.

6. A device according to claim 5, characterized in that the printing station and the set-up stand are equipped with rails in alignment with one another, for displacing the mobile spraying head unit.

7. A device according to claim 5, characterized in that the set-up stand is equipped with a drip trough.

8. A device according to claim 5, characterized in that a space is provided between the printing station and the set-up stand which is accessible by a person.

9. A device according to claim 1, characterized in that the movable unit and a stationary part of the printing station are connected to one another by a cable chain following the direction of movement.

10. A device according to claim 1, characterized in that the device comprises several printing stations succeeding one another in the conveying direction of the substrate, respectively, equipped with a movable unit displaceable along the set path.

11. A device according to claim 10, characterized in that the device comprises several pairs of printing stations succeeding one another in the conveying direction of the substrate.

12. A device according to claim 11, characterized in that a space, accessible by a person in a set-up position, is provided between two adjacent pairs of printing stations.

13. A device according to claim 1, characterized in that the movable unit comprises the spraying head carrying device, as well as a movable stand, extending in the longitudinal direction of the printing station and under the spraying head carrying device and movable in the longitudinal direction of the printing station.

14. A device according to claim 13, characterized in that the spraying head carrying device is mounted on one end side of the movable stand on only one side in such a way that between the movable stand and the spraying head carrying device free space is formed in which the substrate to be patterned comes to rest.

* * * * *